US009925437B2

(12) United States Patent
Fallon

(10) Patent No.: US 9,925,437 B2
(45) **Date of Patent: *Mar. 27, 2018**

(54) DIVOT REPAIR TOOL

(71) Applicant: Sandgroup International Ltd., Hong Kong (HK)

(72) Inventor: Conor Fallon, Co Kildare (IE)

(73) Assignee: Sandgroup International Ltd., Kwai Chung (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/066,618

(22) Filed: Mar. 10, 2016

(65) Prior Publication Data

US 2016/0193513 A1 Jul. 7, 2016

Related U.S. Application Data

(63) Continuation of application No. 14/578,939, filed on Dec. 22, 2014, now Pat. No. 9,381,412.

(60) Provisional application No. 62/072,883, filed on Oct. 30, 2014.

(51) Int. Cl.
*A63B 57/50* (2015.01)
*A63B 57/00* (2015.01)

(52) U.S. Cl.
CPC ..... *A63B 57/50* (2015.10); *A63B 57/0068* (2013.01); *A63B 2210/50* (2013.01)

(58) Field of Classification Search
CPC ..... A63B 57/50; A63B 2210/58; A01B 1/24
See application file for complete search history.

(56) References Cited

U.S. PATENT DOCUMENTS 3,415,518 A * 12/1968 Root ..... A63B 57/60 111/99
3,539,017 A * 11/1970 Johnson ..... A01B 1/24 172/378
4,925,190 A * 5/1990 Learned ..... A01B 1/24 172/378
4,950,013 A * 8/1990 Yonkers ..... B25G 1/102 172/381
4,984,790 A * 1/1991 Dowdy ..... A63B 57/50 473/408
5,022,650 A * 6/1991 Madock ..... A63B 57/50 15/106
5,277,425 A * 1/1994 Petriano, Sr. ..... A01B 1/14 172/381
5,305,999 A * 4/1994 Tate ..... A63B 57/207 224/269
D354,661 S * 1/1995 Linden ..... D8/10
5,449,169 A * 9/1995 Hardin ..... A63B 57/50 473/408
D375,815 S * 11/1996 Kagasoff ..... D21/793
D424,151 S * 5/2000 Miura ..... D21/793
6,062,320 A * 5/2000 Pinto ..... A01B 1/02 172/381
6,224,502 B1 * 5/2001 Warfield ..... A63B 57/50 473/408

(Continued)

*Primary Examiner* — Steven Wong
(74) *Attorney, Agent, or Firm* — Jason T. Daniel, Esq.; Daniel Law Offices, P.A.

(57) ABSTRACT

A divot repair tool includes a main body having an internally located prong assembly having one or more prongs. The prongs selectively transition between an extended and retracted position. At least one of the elongated prongs include a top end having a generally teardrop shape.

14 Claims, 8 Drawing Sheets

(56) References Cited

U.S. PATENT DOCUMENTS 6,244,356 B1 * 6/2001 Luna ..... A01B 1/24 172/381
6,413,174 B1 * 7/2002 Roberts ..... A63B 57/50 473/408
6,428,430 B1 * 8/2002 Chong ..... A63B 57/207 473/406
6,837,807 B1 * 1/2005 Kerr ..... A63B 57/50 473/286
D513,632 S * 1/2006 Sokolowski ..... D21/793
D532,274 S * 11/2006 Demar ..... D8/107
D534,982 S * 1/2007 Miller ..... D21/793
D553,705 S * 10/2007 Barouh ..... D21/721
D719,232 S * 12/2014 Wallander ..... D21/793
9,381,412 B2 * 7/2016 Fallon ..... A63B 57/0068
2004/0023187 A1 * 2/2004 Hickok ..... A61C 3/03 433/119
2005/0070380 A1 * 3/2005 Miller ..... A63B 57/207 473/406
2006/0247075 A1 * 11/2006 Dymling ..... A63B 57/50 473/408
2007/0298900 A1 * 12/2007 Johnson ..... A63B 57/207 473/286
2009/0078280 A1 * 3/2009 Fishman ..... A61C 15/02 132/328
2009/0098952 A1 * 4/2009 Leiber ..... A63B 57/50 473/408
2010/0022330 A1 * 1/2010 Rourke ..... A63B 57/50 473/406
2010/0099519 A1 * 4/2010 Leiber ..... A63B 57/50 473/408
2011/0081994 A1 * 4/2011 Rourke ..... A63B 57/50 473/408
2013/0137058 A1 * 5/2013 Wong ..... A61C 19/004 433/29
2015/0224376 A1 * 8/2015 Maloy ..... A63B 57/207 473/406
2015/0282836 A1 * 10/2015 Hart ..... A61B 17/42 606/144

* cited by examiner

DIVOT REPAIR TOOL

CROSS-REFERENCE TO RELATED APPLICATIONS

This application is a continuation of U.S. patent application Ser. No. 14/578,939 filed on Dec. 22, 2014 which claims priority to U.S. application Ser. No. 62/072,883 filed on 30 Oct. 2014. The contents of each of which are incorporated herein by reference.

TECHNICAL FIELD

The present invention relates generally to sporting goods, and more particularly to a device for use in the game of golf to repair divots.

BACKGROUND

The statements in this section merely provide background information related to the present disclosure and may not constitute prior art.

The game of golf is one of the most widely played sports activities in the world. Golf courses typically include either 9 or 18 holes, each comprising a teeing ground, a fairway area, one or more roughs (and other hazards), as well as a putting green where the hole is located.

Once the golf ball is on the green, a specialized golf club called a putter is used by the golfer. Putters are designed to strike a golf ball in a manner that keeps the ball on the ground, thereby ensuring greater accuracy. In this regard, it is important that the putting green be maintained with a smooth and uniform surface. However, putting greens can be damaged when golf balls are hit from a distance and drop onto the surface of the green. The landing of the ball can produce a depression/divot in the surface of the green, which can seriously affect the ability of the golfer to accurately putt.

There are several known tools for attempting to repair a divot. These tools typically include a plurality of straight shafts that are inserted into the turf at a 45 degree angle, until the distal end of the tool is located beneath the divot. At that time, the user must bend the device so that the portion of the tool under the damaged turf can move upward. This process must be repeated several times as the user must repeat the procedure in a circular pattern around the perimeter of the divot. Unfortunately, by repeatedly puncturing the turf surrounding the divot, these tools often create brown, dead patches of grass or bare exposed soil. This type of action tears the roots from the upper leaf and creates an air pocket between them. When this occurs, the turf is damaged and typically takes at least a month for the green to fully recover.

Accordingly, it would be beneficial to provide a divot repair tool which can allow a user to quickly and easily repair divot marks without suffering from the drawbacks of the above noted devices.

SUMMARY OF THE INVENTION

The present invention is directed to a divot repair tool. One embodiment of the present invention can include a main body having an internally located prong assembly with one or more prongs that can extend and retract from the main body. One or more of the elongated prongs can include a top end having a generally teardrop shape, and the tool can further include a central knob for receiving a twisting motion to transition the main body between the extended and retracted orientation.

Another embodiment of the present invention can include a plurality of elongated prongs having identical or different shapes, sizes, construction materials and ends.

Yet another embodiment of the present invention can include one or more elongated prongs that are fixedly secured along one end of a main body.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
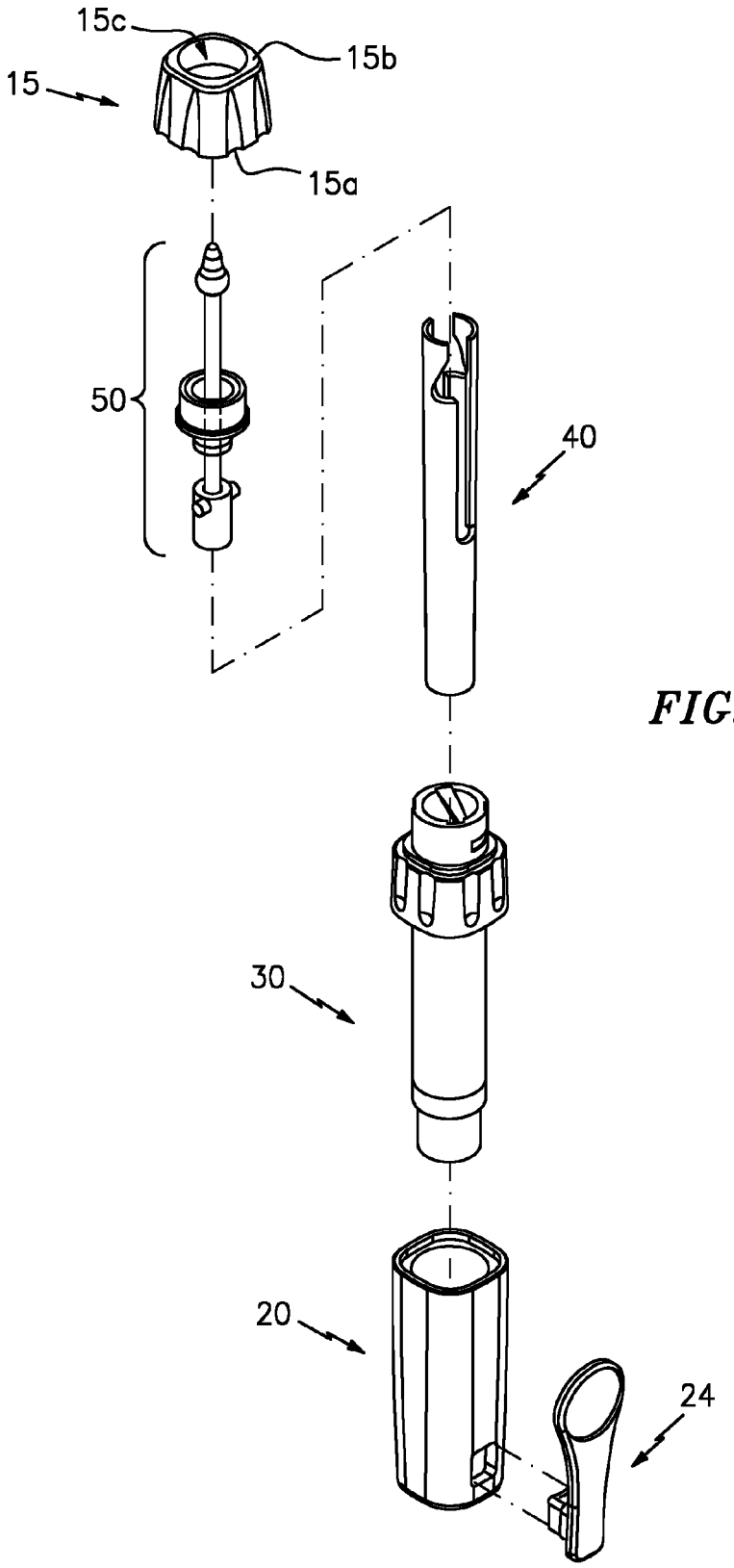
FIG. 1 is an exploded parts view of a divot repair tool that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms.

Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention. Although described with respect to the game of golf, the inventive concepts disclosed herein are not to be construed as limiting to any particular sport or usage, as many other applications are contemplated.

As described herein, the term "indicia" can include any type of decorative elements such as colors, markings, words, shapes, symbols, logos, designs, types of materials, texturing of materials, patterns, images, lithographs, photographs and/or jewels such as rubies, diamonds, emeralds and the like. The indicia can be secured onto and/or into the device elements in accordance with known techniques so as to be flush with the surface, or can be raised/protruding outward from the surface so as to give a three dimensional effect.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 is an exploded parts view of one embodiment of a divot repair tool 10 that is useful for understanding the inventive concepts disclosed herein. As shown, the tool 10 can include a cap 15, a main body 20, a rotational cylinder 30, a slide liner 40, and a prong assembly 50.

The cap 15 can include a main body having a large bottom end 15*a* that tapers into a smaller top end 15*b* and a central aperture 15*c*. A connector such as a plurality of threaded elements (not illustrated), for example can be positioned along the bottom end 15*a* which can engage a complementary connector such as the threaded elements located on the below described cylinder 30.

Figure 2:
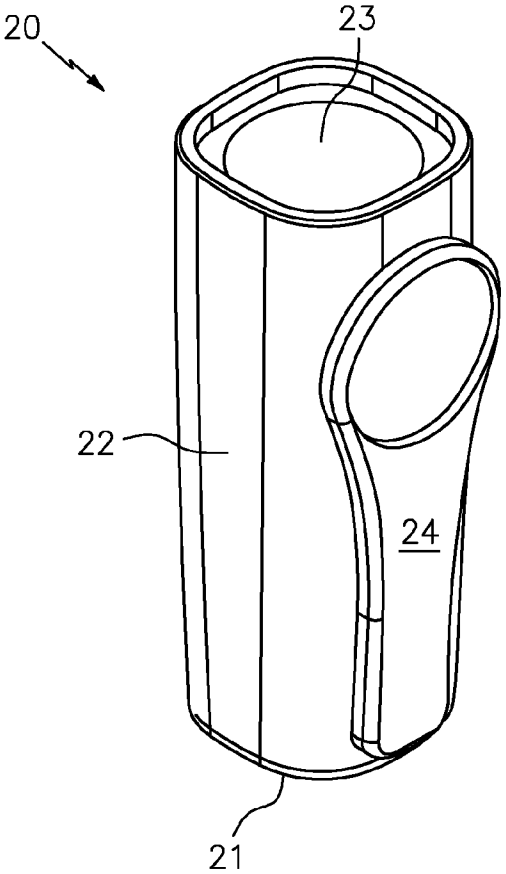
FIG. 2 is a perspective view of the main body of the divot repair tool, in accordance with one embodiment of the invention.

FIG. 2 illustrates one embodiment of the main body 20 that includes an elongated, generally cylindrical member having a capped bottom end 21 a hollow central portion 22, and an open top end 23. The main body can preferably be constructed from a lightweight waterproof material such as plastic, for example; however, any number of other materials such as steel, aluminum and/or various composite materials are also contemplated. The main body can function to house the below described elements, and to operate as a handle for the device user. As such, the main body can be manufactured in any number of different shapes and dimensions such as various lengths, widths and/or thicknesses, for example. Moreover, the main body can include any number of indicia to suit a variety of interests. Further, an optional belt clip 24 or other such retention device can be secured to, or included with the construction of the main body, and can function to allow a user to easily carry the device on their person.

Figure 3:
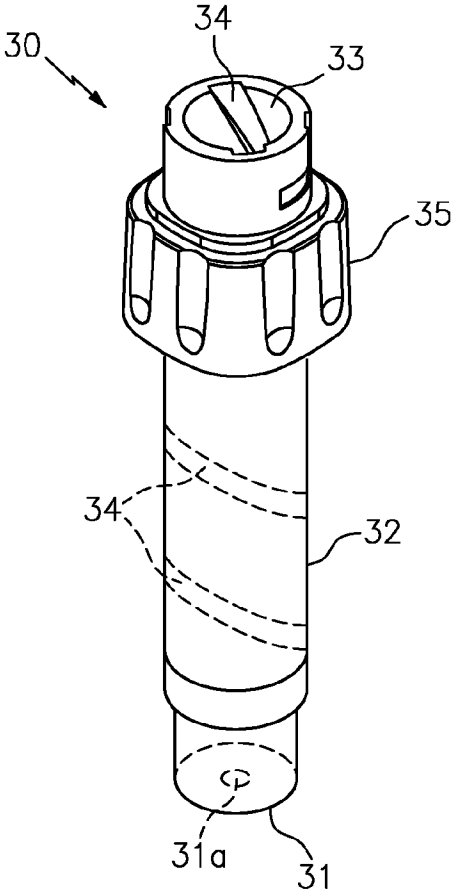
FIG. 3 is a perspective view of the rotational cylinder of the divot repair tool, in accordance with one embodiment of the invention.

FIG. 3 illustrates one embodiment of the rotational cylinder 30 which can be housed within the main body 20, and is rotatably mounted with respect to, and extends upwardly from the capped bottom surface 21. As shown, the cylinder includes a bottom end 31, a hollow central portion 32, an open top end 33, and a plurality of spiral grooves 34 located along the inside surface of the central portion. The cylinder body includes a shape and dimension that is suitable for insertion within the main body 20, and the cylinder further includes a disc/knob section 35 adjacent to the top end 33. The knob 35 can be positioned against the top surface of the main body via a connector (not shown) and can operate to transition the below described prong(s) between an extended and retracted position.

Figure 4:
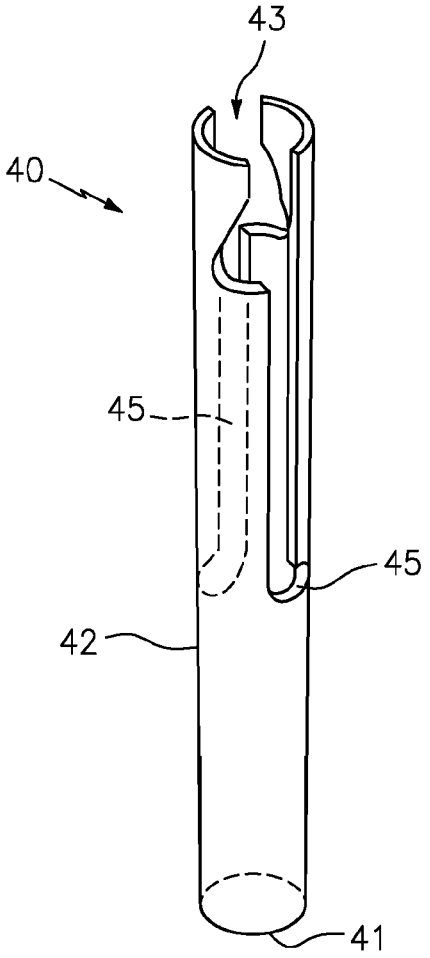
FIG. 4 is a perspective view of the slide liner of the divot repair tool, in accordance with one embodiment of the invention.

FIG. 4 illustrates one embodiment of the tubular slide liner 40, which can be positioned within the cylinder 30. As shown, the liner 40 can include a bottom end 41, a hollow central portion 42, an open top end 43, and a pair of elongated slots 44 extending along the central portion. The liner 40 includes a shape and dimension that is suitable for insertion within the cylinder 30, such that the bottom end 41 can be secured to the capped bottom surface 21 via a fastener (not illustrated) that extends through an opening 31*a* within the bottom surface of the cylinder 31. In this regard, the slide liner 40 is fixedly secured within the main body 20, and the cylinder 30 is secured within the main body 20 in a manner that permits rotation of the cylinder 30 about the tubular slide liner 40.

In the preferred embodiment, each of the cylinder 30 and slide liner 40 can be constructed from lightweight materials such as injection molded plastic, for example. However, any number of other materials and/or markings, such as those described above with respect to the main body 20 is also contemplated. In this regard, each of the cylinder 30, slide liner 40 and main body 20 can include substantially identical construction materials, or different construction materials than one another.

Figure 5:
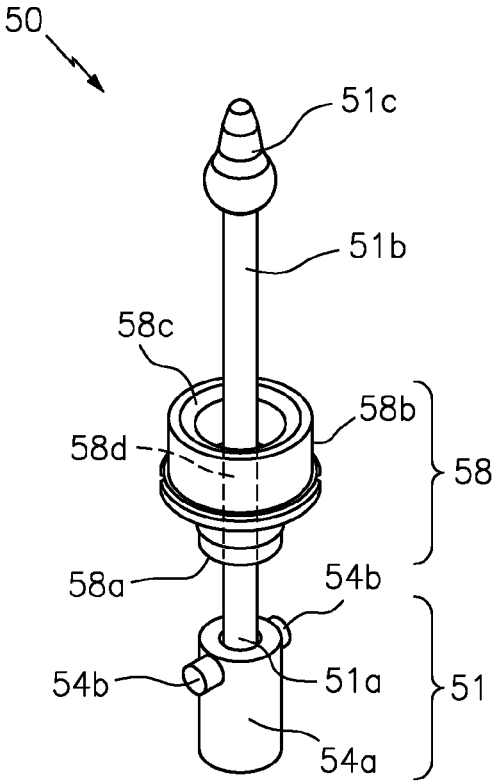
FIG. 5 is a perspective view of the prong assembly of the divot repair tool, in accordance with one embodiment of the invention.

FIG. 5 illustrates one embodiment of the prong assembly 50 that includes at least one elongated prong 51, a prong holder 55, and a tubular sealing member 58.

As shown, the elongated prong 51 can include a bottom end 51*a*, a middle section 51*b* and a pointed, generally teardrop-shaped top end 51*c*. As shown, the teardrop-shaped tip can include a pointed distal end configured to penetrate an organic material during a downward motion, a generally circular proximal end comprising a broad proximal portion that is in communication with the elongated central body section, wherein an outside diameter of the broad proximal portion is greater than an outside diameter of the elongated central body section to engage and apply an upward force to the organic material during an upward motion, and a substantially conically tapered middle section that extends between the pointed distal end and the proximal end. In the preferred embodiment, the elongated prong can be constructed from a sturdy and impact resistant material such as steel, for example, however other forms of metal, plastic and/or composites are also contemplated.

Figure 6:
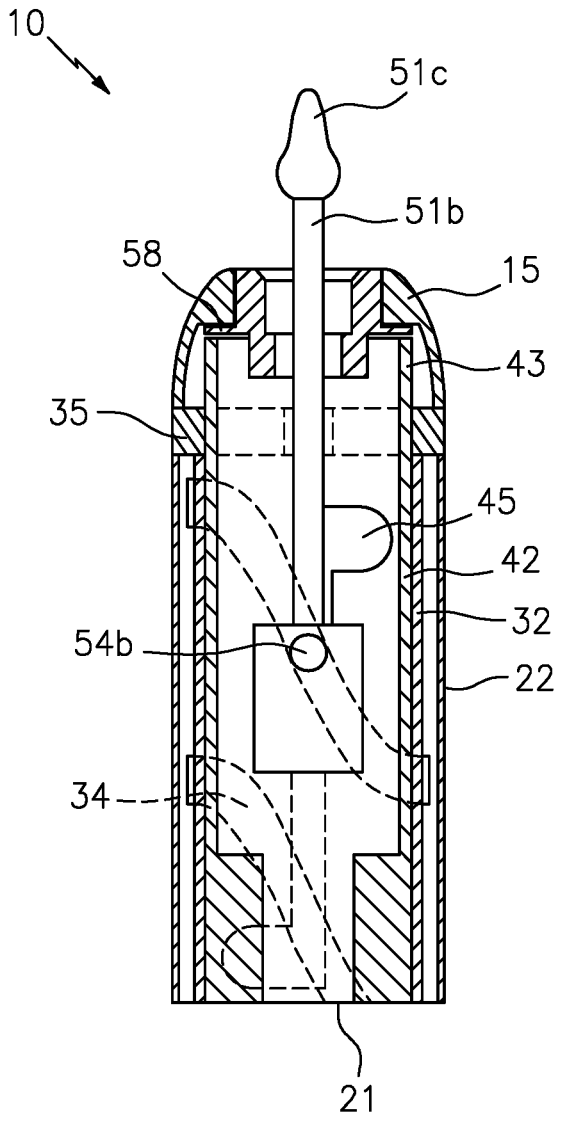
FIG. 6 is a cross sectional view of the divot repair tool, in accordance with one embodiment of the invention.

Although described as including a particular shape and construction material, other embodiments are contemplated wherein the prong or prongs (See FIGS. 9-12) can include any number of different shapes, construction materials, lengths, widths and/or thicknesses, for example, and can also be emblazoned with any number of indicia to suit a variety of interests As shown best in FIG. 6, wherein portions of the elements are removed for clarity, the prong holder 54 can be secured to the bottom end of the elongated prong 51*a*, and can include a central section 54*a* having a pair of opposing posts 54*b* extending outward therefrom. The central section can include a dimension that is suitable for insertion within the slide liner 40, and each of the posts 54*b* can extend through the vertical slots 44 of the slide liner and into spiral grooves 34 formed on the interior of the cylinder 30, whereby the prong 51 and prong holder 54 move longitudinally with respect to the cylinder 30 upon rotation of the knob 35.

A tubular sealing member 58 can include a bottom end 58*a*, a middle section 58*b* and a top end 58*c*, having a central aperture 58*d* through which the middle portion of the elongated prong 51*b* can be positioned. The aperture can include a diameter that is complementary to the diameter of the middle portion 51*b*, so as to allow the prong to slide linearly between an extended and retracted position. The outside portion of the sealing member can include a dimension that is approximate to the opening of the cap 15*c*. In this regard, the sealing member can work in conjunction with the cap 15 to prevent foreign objects such as sand and other such debris from entering the main body 20, the channel 30, the and the slide liner 40, so as to prevent a buildup of material that could prevent normal and intended device operation.

As described herein, each of the prong holder 54 and the sealing member 58 can be constructed from lightweight materials such as injection molded plastic, for example. However, any number of other materials and/or markings, such as those described above with respect to the main body 20 are also contemplated. Although described above as utilizing a particular arrangement of components to transition the tool between an extended and retracted state, those of skill in the art will recognize that many other mechanisms can be employed to perform the described functionality without undue experimentation. To this end, any form of linear sliding mechanism, ratchet mechanism, twisting mechanism and the like are also contemplated.

Figure 7B:
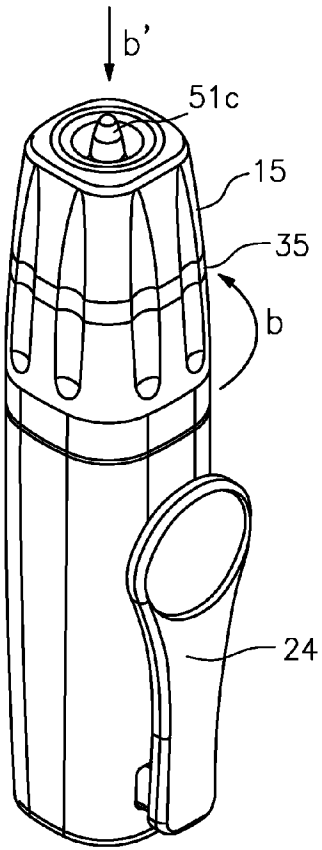
FIG. 7B is a perspective view of the divot repair tool in a retracted position, in accordance with one embodiment of the invention.
Figure 7A:
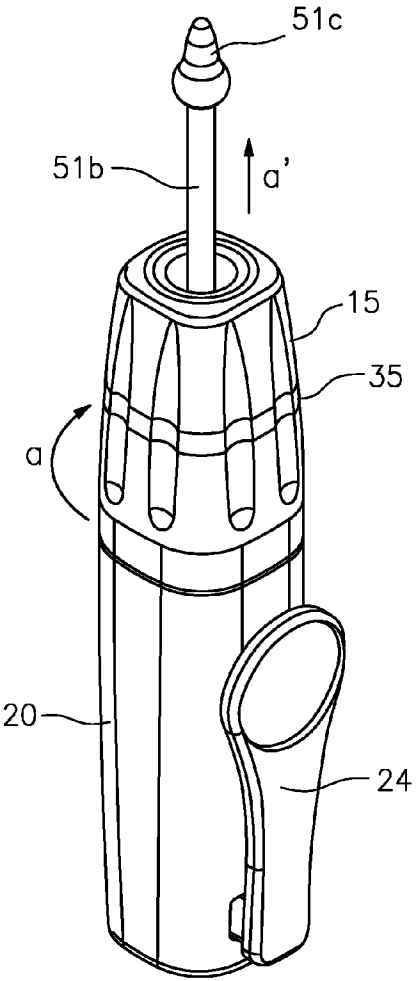
FIG. 7A is a perspective view of the divot repair tool in an extended position, in accordance with one embodiment of the invention.

FIGS. 7A and 7B illustrate one embodiment of the tool 10 in an extended and retracted position, respectively. In operation, when a twisting motion in a first direction indicated by arrow a is applied to the knob 35, the device cylinder 30 rotates with respect to the main body 20 and the slide liner 40, thereby causing the posts to travel upwards along the vertical slots 44 and the spiral grooves 34 as shown by arrow a'. As this occurs, the prong extends upward until reaching a fully extended position. Conversely, after the prong has been used, a twisting motion in a second direction indicated by arrow b can be applied to the knob 35, causing the post to retract within the main body as shown by arrow b'.

Figure 8:
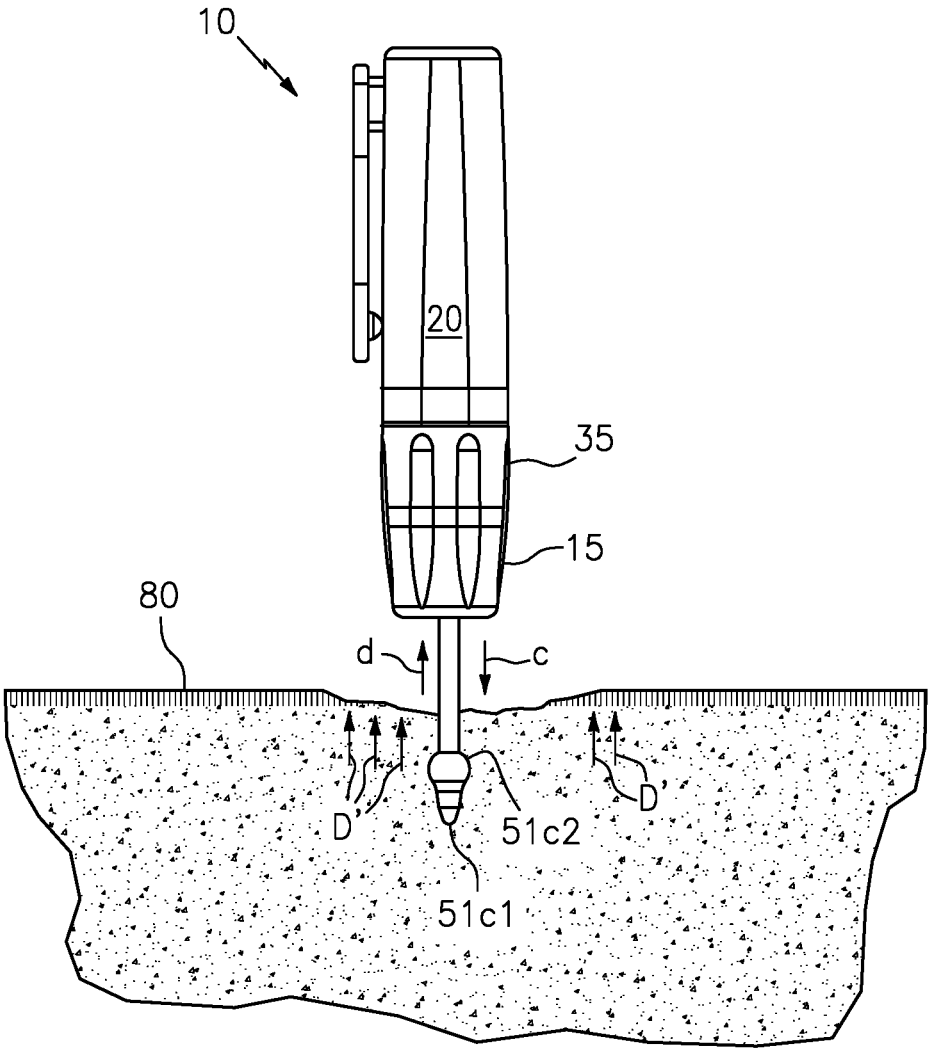
FIG. 8 is a perspective view of the divot repair tool in operation, and in accordance with one embodiment of the invention.
Figure 9:
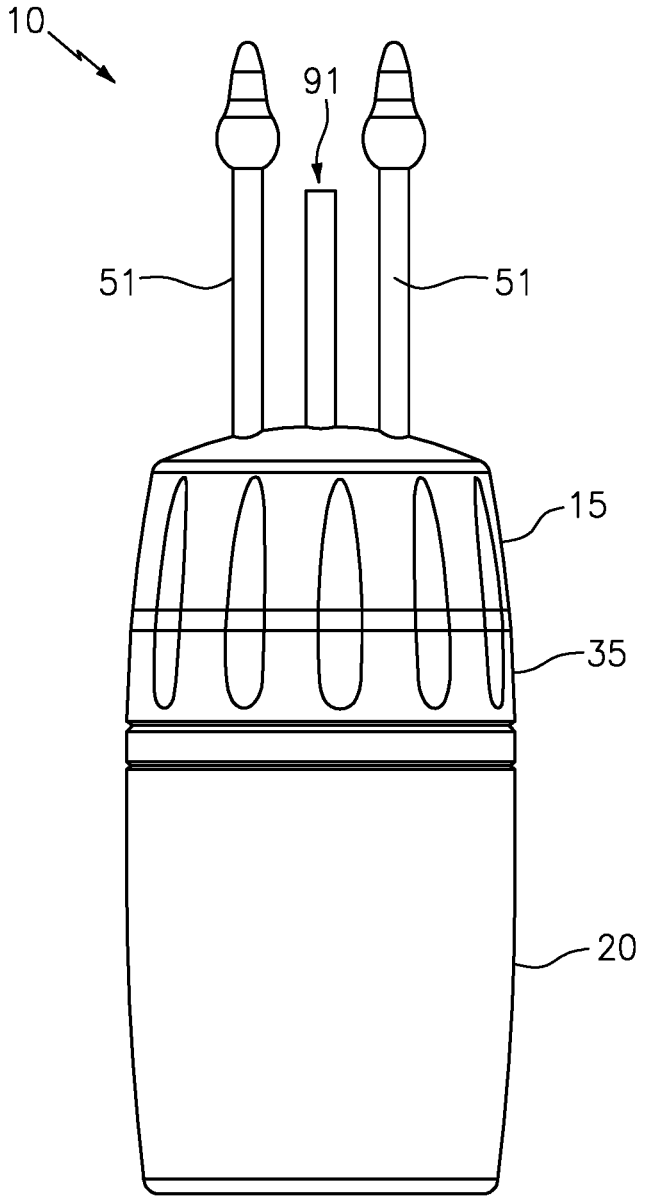
FIG. 9 is a side view of the divot repair tool, in accordance with another embodiment of the invention.

By providing a teardrop-shaped distal end, each prong can be inserted into the central portion of a divot in a vertical (i.e., 90 degree angle with the ground), and can restore the damaged turf to a straight and level playing surface with a single attempt. In this regard, FIG. 8 illustrates one embodiment of the device in operation to repair damaged turf. As shown, the pointed distal section 51*c*1 can easily penetrate organic material such as a golf course green 80 (see arrow c). Once positioned beneath the green surface, the broad proximal tip portion 51*c*2 can engage a large section of turf, and when the tip is pulled upward (see arrow d), can assert an upward motion (arrows d') onto the bottom of the turf, thereby restoring the turf to a flat and level orientation. In this regard, the present tool can function to restore the turf in a single step, and with a single puncture. As such, the collateral damage to the turf caused by the tool is severely less than utilizing a conventional device.

In addition to the above, the tool can also be inserted at an angle from the outside edge of the divot/ball mark and then pushing or levering the upper part of the tool forward and stretching new grass in over the damaged area. This action can be repeated all around the ball mark. When so performed, the tool functions to cover the divot area with new ground, thus preventing an air pocket from forming (as happens with conventional divot repair tools) thus ensuring the turf does not become damaged and/or die.

Although illustrated with respect to a single prong, other embodiments having a plurality of prongs are also contemplated. For example, FIG. 9A illustrates another embodiment of the tool 10 that includes three prongs 51, 51 and 91, for example. As shown, the prongs can be arranged in any orientation to one another, and can include any number of different shapes, sizes and construction materials. Such features can allow a single device to repair large sections of damaged turf, in a manner similar to that described above.

Figure 12:
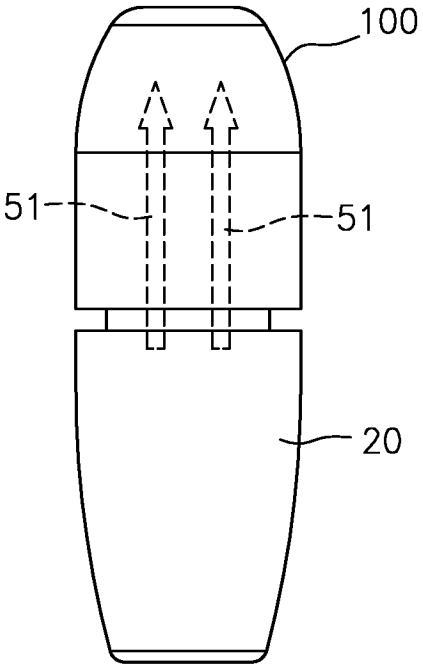
FIG. 12 is a side view of the divot repair tool, in accordance with yet another alternate embodiment of the invention.
Figure 11:
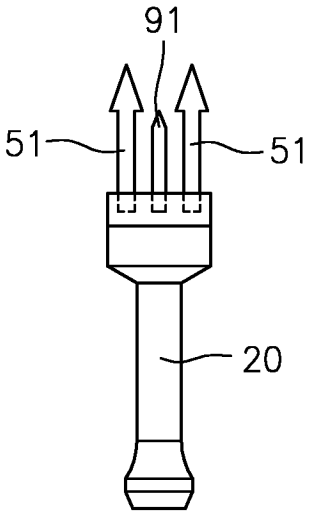
FIG. 11 is a side view of the divot repair tool, in accordance with another alternate embodiment of the invention.
Figure 10:
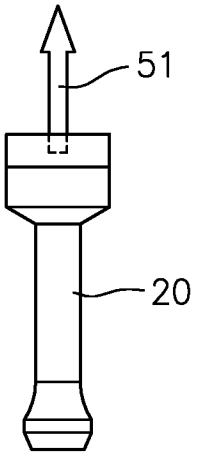
FIG. 10 is a side view of the divot repair tool, in accordance with an alternate embodiment of the invention.

FIGS. 10-12 illustrate alternate embodiments of the divot repair tool wherein one or more prongs 51 and 91 include a fixed orientation. In the present embodiments, the main body 20 can include a solid plastic or composite construction, and the bottom ends of the prongs 51*a* and 91*a* can be permanently embedded within the handle section. Moreover, as shown in FIG. 12, each of these devices can further include a cap 100 or other such device capable of mating with the top portion of the handle, and surrounding the extended prong(s) when the device is not in use. Such a feature can allow the tool 10 to be manufactured in a more cost effective variant while allowing a user to enjoy the inventive concepts disclosed herein.

As described herein, each element of the divot repair tool can be constructed from any number of different materials such as plastic, steel or aluminum, for example, which are durable and resistant to adverse weather conditions. Additionally, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements of the device may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A divot repair tool, comprising:

an elongated main body having a bottom end, a central portion and a top end; and a prong assembly that includes at least one elongated prong having a bottom end that is in communication with the main body, an elongated central body section, and a teardrop-shaped tip that is positioned along a distal end of the elongated central body section, wherein the teardrop-shaped tip comprises:

a pointed distal end configured to penetrate an organic material during a downward motion;

a generally circular proximal end comprising a broad proximal portion that is in communication with the elongated central body section, wherein an outside diameter of the broad proximal portion is greater than an outside diameter of the elongated central body section to engage and apply an upward force to the organic material during an upward motion; and a substantially conically tapered middle section that extends between the pointed distal end and the proximal end, and wherein the at least one elongated prong comprises a plurality of elongated prongs, and one of the plurality of elongated prongs includes a top end shape that is different from a top end shape of another of the elongated prongs.

2. The tool of claim 1, further comprising:

a cap that is configured to selectively engage the top end of the elongated main body, said cap further including a central aperture for encompassing the prong assembly.

3. The tool of claim 1, wherein the prong assembly is telescopically connected to the elongated main body and is configured to selectively transition between an extended position and a retracted position.

4. The tool of claim 3, wherein the teardrop-shaped tip of each of the at least one elongated prongs protrude outward from the top end of the elongated main body when the device is in the extended position.

5. The tool of claim 1, wherein the top end teardrop-shaped tip of each of the at least one elongated prongs are located within a central aperture of the main body when the device is in a retracted position.

6. The tool of claim 1, wherein the at least one elongated prong comprises:

a single elongated prong.

7. The tool of claim 1, further comprising:

a belt clip that is secured along the main body.

8. The tool of claim 1, wherein the elongated main body is a handle for a user of the divot repair tool.

9. The tool of claim 8, wherein the prong assembly is parallel with the handle.

10. The tool of claim 1, wherein the broad proximal portion is substantially perpendicular to the elongated central body section.

11. A divot repair tool, comprising:

an elongated main body having a bottom end, a central portion and a top end; and a prong assembly that includes at least one elongated prong having a bottom end that is in communication with the main body, an elongated central body section, and a teardrop-shaped tip that is positioned along a distal end of the elongated central body section, wherein the at least one elongated prong comprises two elongated prongs, each having a teardrop-shaped tip along the distal end, and wherein each of the teardrop-shaped tips comprise:

a pointed distal end configured to penetrate an organic material during a downward motion;

a generally circular proximal end comprising a broad proximal portion that is in communication with the elongated central body section, wherein an outside diameter of the broad proximal portion is greater than an outside diameter of the elongated central body section to engage and apply an upward force to the organic material during an upward motion; and a substantially conically tapered middle section that extends between the pointed distal end and the proximal end.

12. A divot repair tool, comprising:

an elongated main body having a bottom end, a central portion and a top end; and a prong assembly that includes at least one elongated prong having a bottom end that is in communication with the main body, an elongated central body section, and a teardrop-shaped tip that is positioned along a distal end of the elongated central body section, wherein the at least one elongated prong comprises:

a first elongated prong having a teardrop-shaped tip along the distal end;

a second elongated prong having a teardrop-shaped tip along the distal end; and a third elongated prong, said third prong including a different shape that the first and second elongated prongs, and wherein each of the teardrop-shaped tips comprise:

a pointed distal end configured to penetrate an organic material during a downward motion;

a generally circular proximal end comprising a broad proximal portion that is in communication with the elongated central body section, wherein an outside diameter of the broad proximal portion is greater than an outside diameter of the elongated central body section to engage and apply an upward force to the organic material during an upward motion; and a substantially conically tapered middle section that extends between the pointed distal end and the proximal end.

13. A divot repair tool, comprising:

an elongated main body having a bottom end, a central portion and a top end; and a prong assembly that includes at least one elongated prong having a bottom end that is in communication with the main body, an elongated central body section, and a teardrop-shaped tip that is positioned along a distal end of the elongated central body section, wherein the at least one elongated prong includes:

a plurality of elongated prongs, and a middle section of one of the plurality of elongated prongs includes a shape that is different from a shape of a middle section of another of the elongated prongs, and wherein the teardrop-shaped tip comprises:

a pointed distal end configured to penetrate an organic material during a downward motion;

a generally circular proximal end comprising a broad proximal portion that is in communication with the elongated central body section, wherein an outside diameter of the broad proximal portion is greater than an outside diameter of the elongated central body section to engage and apply an upward force to the organic material during an upward motion; and a substantially conically tapered middle section that extends between the pointed distal end and the proximal end.

14. A divot repair tool, comprising:

an elongated main body having a bottom end, a central portion and a top end;

a belt clip that is secured along the main body; and a prong assembly that includes at least one elongated prong having a bottom end that is in communication with the main body, an elongated central body section, and a teardrop-shaped tip that is positioned along a distal end of the elongated central body section, wherein the teardrop-shaped tip comprises:

a pointed distal end configured to penetrate an organic material during a downward motion;

a generally circular proximal end comprising a broad proximal portion that is in communication with the elongated central body section, wherein an outside diameter of the broad proximal portion is greater than an outside diameter of the elongated central body section to engage and apply an upward force to the organic material during an upward motion; and a substantially conically tapered middle section that extends between the pointed distal end and the proximal end.

* * * * *